US006622488B2

(12) United States Patent
Mansour et al.

(10) Patent No.: US 6,622,488 B2
(45) Date of Patent: Sep. 23, 2003

(54) PURE AIRBLAST NOZZLE

(75) Inventors: Adel B. Mansour, Mentor, OH (US); Michael A. Benjamin, Shaker Heights, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 70 days.

(21) Appl. No.: 10/010,216

(22) Filed: Dec. 7, 2001

(65) Prior Publication Data

US 2002/0134084 A1 Sep. 26, 2002

Related U.S. Application Data

(60) Provisional application No. 60/277,572, filed on Mar. 21, 2001.

(51) Int. Cl.[7] ..... F02C 1/00; B05B 7/10

(52) U.S. Cl. ..... 60/740; 60/748; 239/403; 239/405

(58) Field of Search ..... 60/740, 742, 748; 239/403, 404, 405, 406, 399

(56) References Cited

U.S. PATENT DOCUMENTS

| | | | | |
|---|---|---|---|---|
| 3,028,102 A | | 4/1962 | Davies et al. | |
| 3,029,029 A | | 4/1962 | Webster | |
| 3,638,865 A | | 2/1972 | McEneny et al. | |
| 3,684,186 A | * | 8/1972 | Helmrich | 239/403 |
| 3,866,413 A | | 2/1975 | Sturgess | |
| 3,980,233 A | | 9/1976 | Simmons et al. | |
| 4,941,617 A | | 7/1990 | Russell | |
| 5,078,324 A | | 1/1992 | DuBell et al. | |
| 5,605,287 A | | 2/1997 | Mains | |
| 5,761,907 A | | 6/1998 | Pelletier et al. | |
| 5,799,872 A | * | 9/1998 | Nesbitt et al. | 239/406 |
| 6,076,356 A | | 6/2000 | Pelletier | |
| 6,247,317 B1 | * | 6/2001 | Kostka | 60/741 |
| 6,289,676 B1 | * | 9/2001 | Prociw et al. | 60/740 |

* cited by examiner

*Primary Examiner*—Ted Kim
(74) *Attorney, Agent, or Firm*—Christopher H. Hunter

(57) ABSTRACT

A fuel injector for a gas turbine engine of an aircraft has an inlet fitting, a fuel nozzle, and a housing stem with an internal conduit fluidly interconnecting the nozzle and fitting. The fuel nozzle includes a fuel swirler, which includes a plenum for receiving fuel from the conduit. A plurality of fuel passages direct fuel from the plenum to discharge orifices. The downstream ends of the passages are angled such that a swirl component is imparted to fuel exiting the discharge orifices. The swirling fuel is then applied to a prefilmer, which outwardly surrounds the fuel swirler. The passages in the fuel swirler are arranged such that the discharge orifices surround the entire nozzle for the even distribution of fuel. The plenum and passages are dimensioned and configured to receive and distribute the fuel for uniform spray patternization and low pressure drop, which provides improved combustion and flame stability.

16 Claims, 6 Drawing Sheets

PURE AIRBLAST NOZZLE

CROSS-REFERENCE TO RELATED CASES

The present application claims the benefit of the filing date of U.S. Provisional Application Ser. No. 60/277,572; filed Mar. 21, 2001.

FIELD OF THE INVENTION

The present invention relates generally to fuel injectors for gas turbine engines of aircraft, and more particularly to fuel swirlers for such fuel injectors.

BACKGROUND OF THE INVENTION

Fuel injectors for gas turbine engines on an aircraft direct fuel from a manifold to a combustion chamber. The fuel injector typically has an inlet fitting connected to the manifold for receiving the fuel, a fuel spray nozzle located within the combustion chamber of the engine for atomizing (dispensing) the fuel, and a housing stem extending between and supporting the fuel nozzle with respect to the fitting. Appropriate check valves and/or flow dividers can be disposed within the fuel nozzle to control the flow of fuel through the nozzle. The fuel injector is typically heat-shielded to protect the injector from the high operating temperatures within the engine casing. The fuel injector has an attachment flange which enables multiple injectors to be attached to the combustor casing of the engine in a spaced-apart manner around the combustor to dispense fuel in a generally cylindrical pattern.

Fuel tube(s) are provided through the housing stem, and typically direct fuel received in the fitting into an annulus surrounding the upstream end of a fuel swirler in the nozzle. The fuel is then directed downstream along the fuel swirler in an annular flow, or in a series of discrete passages, to discharge orifices. At the downstream end of the swirler, the passages are angled, or swirler vanes are provided, to impart a swirling component of motion to the fuel. The swirling fuel is applied against an annular prefilmer outwardly surrounding the fuel swirler, and then impacted by inner and outer swirling air flows to provide an atomized fuel spray. The swirling, atomized spray is ignited downstream of the nozzle in the combustor. Examples of such nozzles are shown in U.S. Pat. Nos. 3,980,233; 5,761,907; and 6,076,356.

While the nozzle design described above has been used for many years and provides a satisfactory fuel spray, one drawback of such a design is that, at low fuel flow rates and pressures typical of start up conditions, the fuel entering the annulus tends to be directed by pressure and gravity to the lower (6 o'clock) portion of the annulus. A greater amount of fuel is then directed through the passages at the lower portion to the discharge orifices. The resulting spray tends to have streaks of fuel, which decreases the efficiency of combustion and the stability of the flame. At high power conditions, the 6 o'clock pocket tends to accumulate some of the fuel due to the presence of a recirculation zone. The residence time of the fuel is increased significantly, thereby increasing the propensity for carbon formation. In low fuel velocity regions, local heat transfer coefficients are also reduced resulting in increased wetted wall temperatures, which can lead to coking internally of the fuel passages.

U.S. Pat. No. 5,799,872 shows and describes a main injector having a pair of inlet chambers along a fuel swirler, where each inlet chamber receives fuel from a separate fuel conduit, and directs the fuel along one or more curved fuel passages to downstream discharge orifices. The discharge orifices associated with each chamber appear to be spaced about ninety degrees apart from each other, or otherwise around only a portion of the nozzle, as the orifices from the other fuel circuit are located on the opposite side of the nozzle tip. A pilot injector is also shown, where a single fuel conduit feeds a single inlet chamber leading to plural fuel passages. The main injector includes air passages in certain of the fuel passages which interconnect the fuel passages with the inner air channel to create back pressure for fuel purging purposes. It is believed such air passages would decrease the uniformity of the spray, and hence decrease the efficiency of combustion. Also, such passages could allow fuel to enter the inner air channel, which could lead to coking internally of the swirler. The fuel passages along the fuel swirler (at least for the main injector) are also curved, which can be difficult to machine. Still further, the inlet chambers appear to have small dimensions, which could restrict fuel flow into the passages, and hence increase the pressure drop across the nozzle.

Thus it is believed there is a demand in the industry for a further improved fuel injector for gas turbine engines, and particularly for a fuel swirler for such an injector, which provides a uniform spray for efficient combustion and stability of the flame; minimizes the pressure drop across the swirler; is simple and low-cost to manufacture; and prevents coking internally of the nozzle.

SUMMARY OF THE INVENTION

The present invention provides a novel and unique fuel injector for a gas turbine engine of an aircraft, and more particularly, a novel and unique fuel swirler for the fuel injector. The fuel swirler provides uniform spray for efficient combustion and stability of the flame; minimizes the pressure drop across the fuel swirler; is simple and low-cost to manufacture; and prevents coking internally of the nozzle.

According to the principles of the present invention, the fuel injector has an inlet fitting for receiving fuel, a fuel nozzle for dispensing fuel, and a housing stem fluidly interconnecting the fuel nozzle and the fitting. The fuel injector can be easily assembled with the engine combustor by a flange extending outwardly from the housing stem, and easily disassembled for inspection or replacement.

The fuel nozzle includes a fuel swirler, which directs fuel from a fuel conduit in the housing stem to discharge openings at the downstream end of the swirler. The fuel swirler includes a gallery or plenum for receiving the fuel from the fuel conduit. A plurality of fuel passages are provided to direct fuel from the plenum downstream along the fuel swirler. Each passage opens at the upstream end to the plenum, and terminates at its downstream end in a discharge orifice. The downstream end of the passages are angled such that a swirl component of motion is imparted to the fuel exiting the discharge orifices. The swirling fuel is then applied to a prefilmer, which outwardly surrounds the fuel swirler.

The passages in the fuel swirler are arranged such that the discharge orifices surround the entire nozzle for the even distribution of fuel. The plenum and passages are also dimensioned to receive and distribute the fuel for uniform spray patternization and low pressure drop. The uniform spray patternization and low pressure drop provide improved combustion and flame stability. The fuel residence time in the nozzle is also minimized, which prevents coking.

The present invention thereby provides an improved fuel injector for gas turbine engines, and particularly an improved fuel swirler for such an injector, which provides a uniform spray for efficient combustion and stability of the flame; minimizes the pressure drop across the swirler; is simple and low-cost to manufacture; and prevents coking internally of the nozzle.

Other features and advantages of the present invention will become further apparent upon reviewing the following specification and attached drawings.

DETAILED DESCRIPTION OF THE PREFERRED EMBODIMENT

Figure 1:
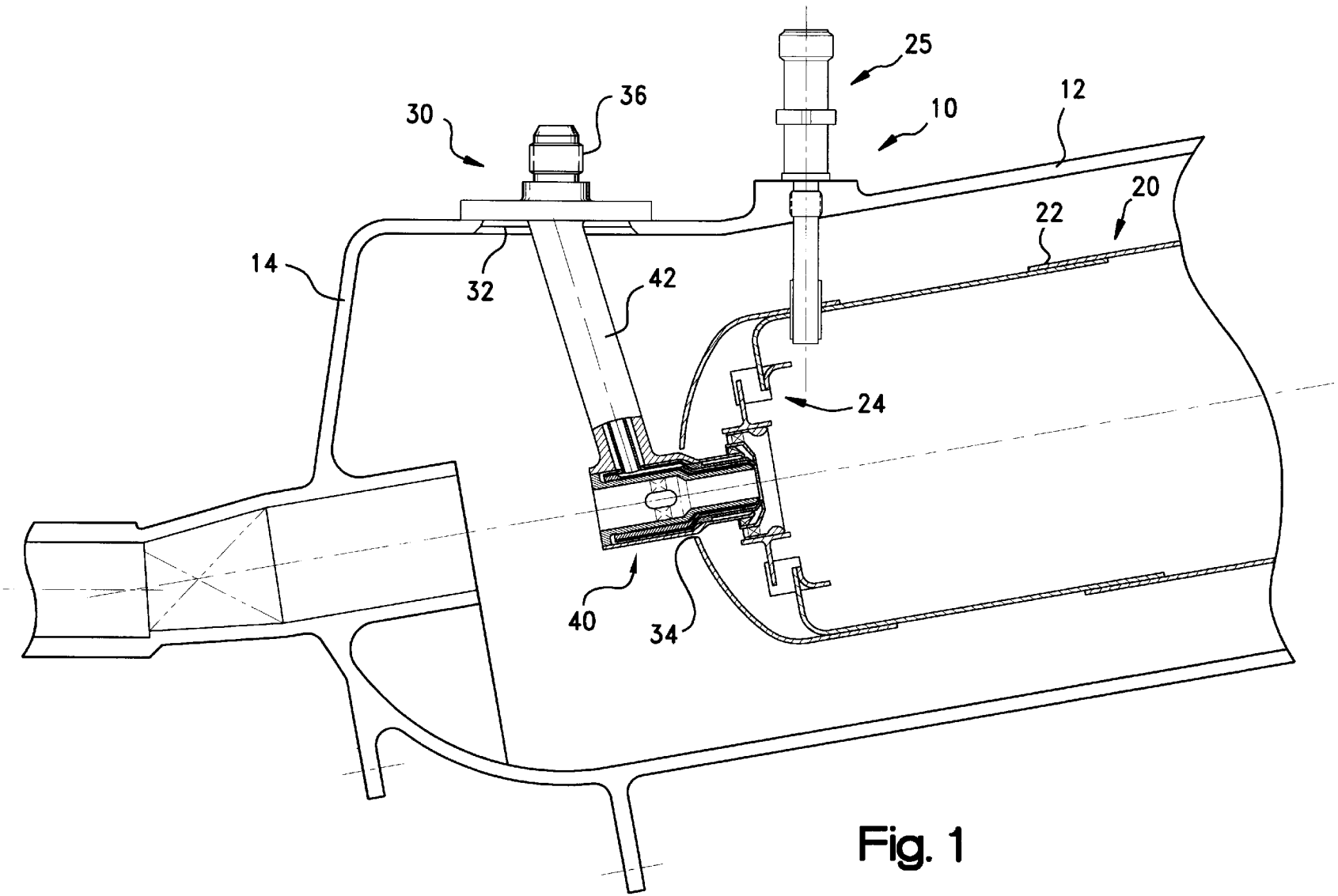
FIG. 1 is a perspective view of a portion of a gas turbine engine illustrating a fuel injector constructed according to the principles of the present invention.

Referring to the drawings, and initially to FIG. 1, a gas turbine engine for an aircraft is illustrated generally at 10. The gas turbine engine 10 includes an outer casing 12 extending forwardly of an air diffuser 14. The casing and diffuser enclose a combustor, indicated generally at 20, for containment of the burning fuel. The combustor 20 includes a liner 22 and a combustor dome, indicated generally at 24. An igniter, indicated generally at 25, is mounted to casing 12 and extends inwardly into the combustor for igniting fuel. The above components are conventional in the art and their manufacture and fabrication are well known.

A fuel injector, indicated generally at 30, is received within an aperture 32 formed in the engine casing and extends inwardly through an aperture 34 in the combustor liner. Fuel injector 30 includes a fitting 36 disposed exterior of the engine casing for receiving fuel; a fuel nozzle, indicated generally at 40, disposed within the combustor for dispensing fuel; and a housing stem 42 interconnecting and structurally supporting nozzle 40 with respect to fitting 36.

Figure 2:
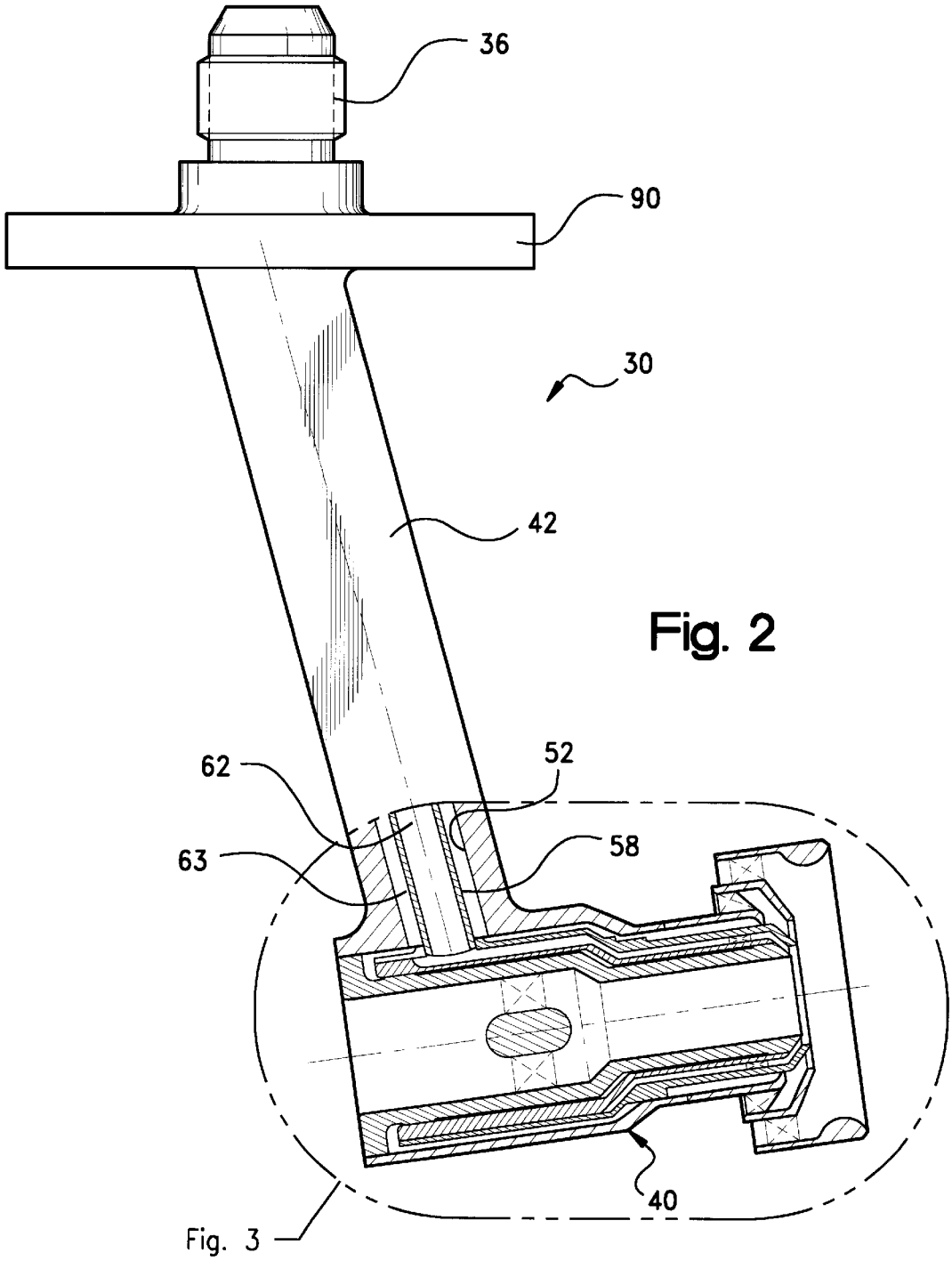
FIG. 2 is a partial cross-sectional side view of the fuel injector of FIG. 1.

Referring now to FIG. 2, housing stem 42 includes a central, longitudinally-extending bore 52 extending the length of the housing stem. A fuel conduit 58 extends through the bore and fluidly interconnects fitting 36 and nozzle 40. Fuel conduit 58 has a hollow central passage 62 for the passage of fuel. Preferably, fuel conduit 58 is closely surrounded by the bore 52 of the housing stem, and an annular air gap 63 is provided between the exterior surface of the fuel conduit 58 and the walls of the bore 52. The air gap 63 provides thermal protection for the fuel in the fuel conduit. Housing stem 42 has a thickness sufficient to support nozzle 40 in the combustor when the injector is mounted to the engine, and is formed of material appropriate for the particular application.

An annular flange 90 is formed in one piece with the housing stem 42 proximate the fitting 36, and extends radially outward therefrom. Flange 90 includes appropriate apertures to allow the flange to be easily and securely connected to, and disconnected from, the casing of the engine using, e.g., bolts or rivets. As shown in FIG. 1, flange 90 has a flat lower surface which is disposed against the flat outer surface of the casing.

Figure 3:
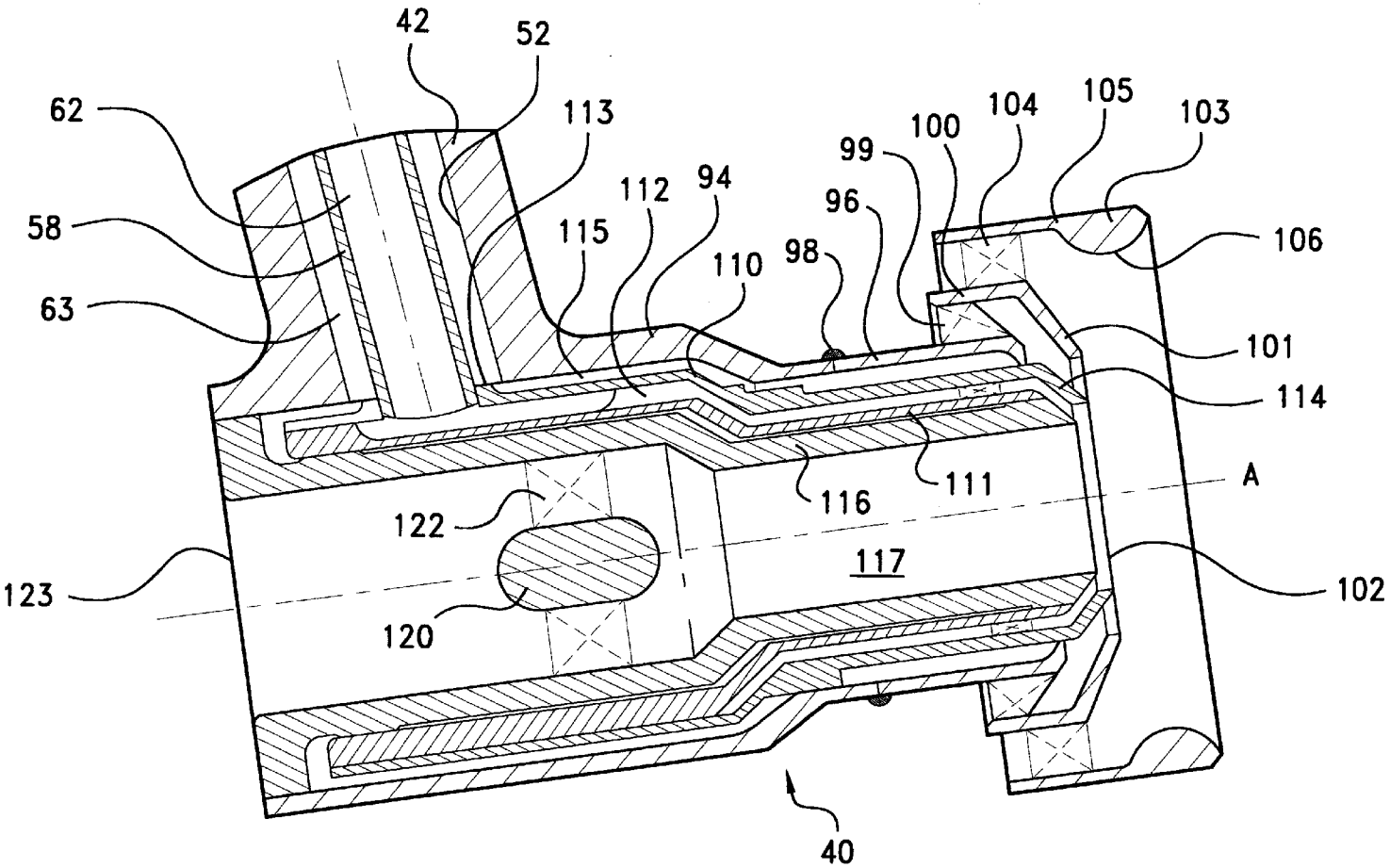
FIG. 3 is an enlarged, cross-sectional side view of a portion of the fuel injector of FIG. 2.
Figure 8:
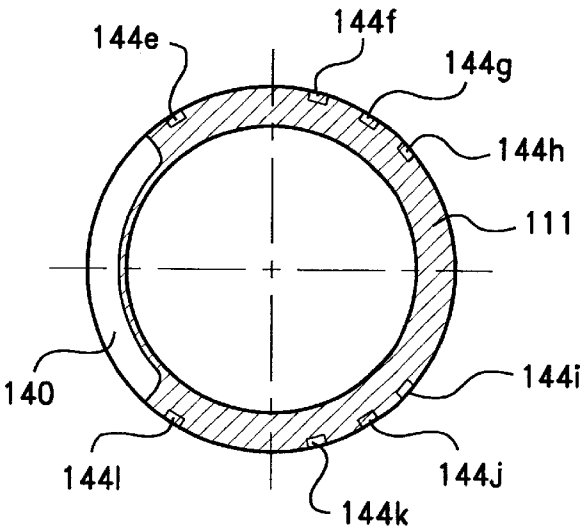
FIG. 8 is a cross-sectional end view of the fuel swirler, taken substantially along the plane described by the lines 8—8 of FIG. 4.
Figure 4:
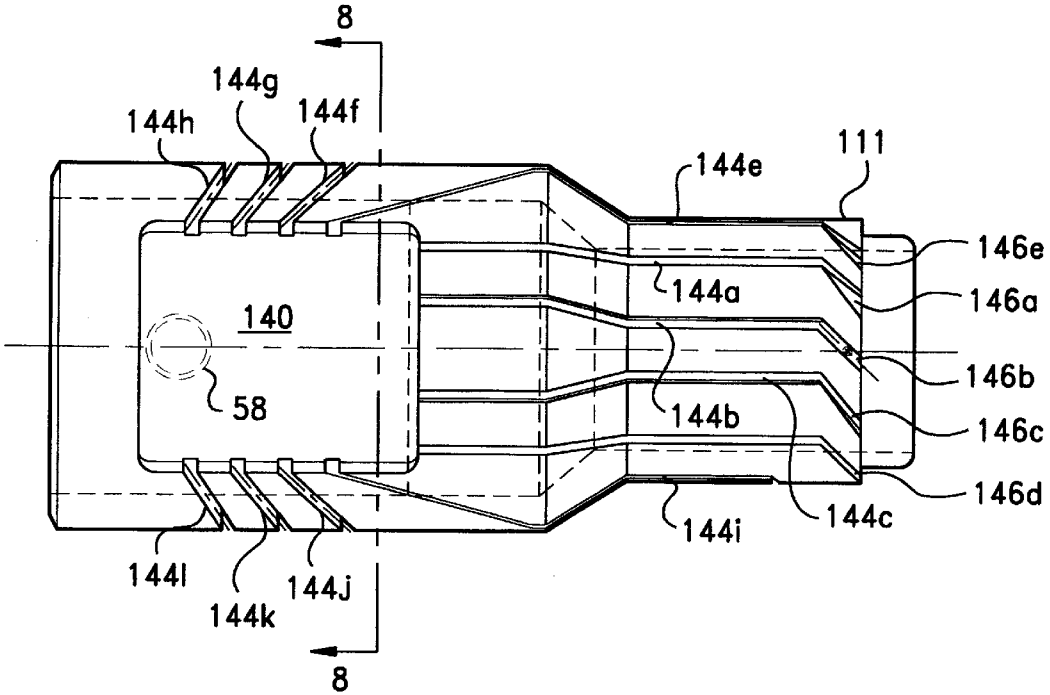
FIG. 4 is a top plan view of the fuel swirler for the fuel injector.
Figure 6:
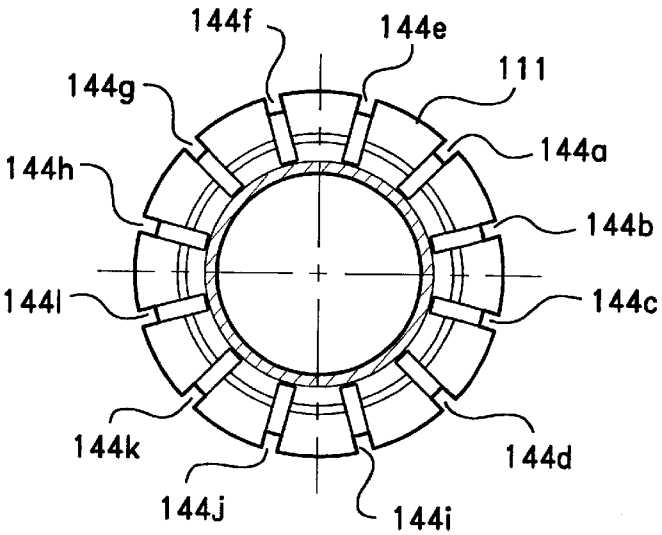
FIG. 6 is a cross-sectional end view taken substantially along the plane described by the lines 6—6 in FIG. 5.
Figure 5:
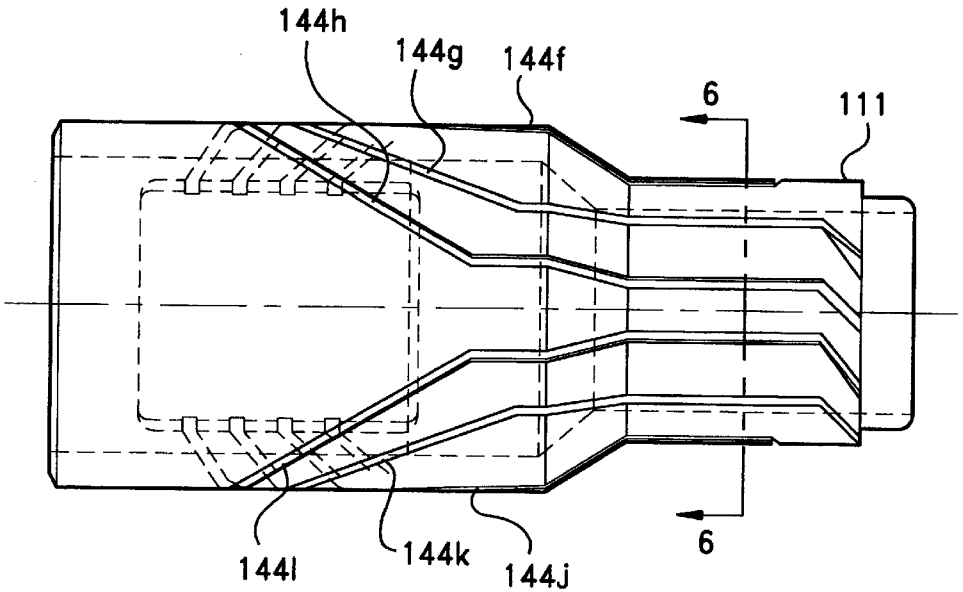
FIG. 5 is a bottom plan view of the fuel swirler for the fuel injector.

The housing stem 42 is formed integrally with fuel nozzle 40, and preferably in one piece with at least a portion of the nozzle. Referring now to FIG. 3, the lower end of the housing stem includes an annular outer shroud 94 circumscribing the longitudinal axis "A" of the nozzle 40. Outer shroud 94 is connected at its downstream end to an annular outer air swirler 96, such as by welding at 98. Outer air swirler 96 includes radially-outward projecting swirler vanes 99 and an annular shroud 100. Shroud 100 is tapered inwardly at its downstream end 101 to direct air in a swirling manner toward the central axis "A" at the discharge end 102 of the nozzle.

A second outer air swirler 103 can also be provided, in surrounding relation to the first air swirler 96. Second air swirler 103 also includes radially-outward projecting swirler vanes 104 and an annular shroud 105. Shroud 105 has a geometry at its downstream end 106 which also directs air in a swirling manner toward the central axis "A" at the discharge end 102 of the nozzle.

An annular prefilmer 110 and an annular fuel swirler 111 are disposed radially inwardly from outer shroud 94. Prefilmer 110 closely surrounds fuel swirler 111, and together with the fuel swirler, defines a pathway as at 112, to direct fuel through the nozzle. Prefilmer 110 has a fuel inlet opening 113 at its upstream end, which receives the downstream end of fuel conduit 58. The fuel conduit 58 is fluidly sealed and rigidly and permanently attached within the opening in an appropriate manner, such as by welding or brazing. Prefilmer 110 is also tapered inwardly at its downstream end 114 to direct fuel in a swirling manner toward the central axis "A" at the discharge end 102 of the nozzle. An annular air gap 115 is provided between shroud 94 and prefilmer 110, which is in communication with air gap 63 in housing stem 42. As with air gap 63, air gap 115 provides thermal protection for the nozzle.

An inner annular heatshield 116 is disposed radially inward from the fuel swirler 111. The inner heatshield extends centrally within the nozzle to protect the fuel from the elevated temperatures. The inner heatshield defines a central air passage 117 extending axially through the nozzle. An air swirler 120 with radially-extending swirler blades 122 is disposed in the air passage proximate the air inlet end 123 of the nozzle. Air swirler 120 directs air in a swirling manner along the central axis "A" of the nozzle to the discharge end 102.

As described above, the fuel pathway 112 between the fuel swirler and the prefilmer directs fuel downstream from the fuel conduit 58 to the discharge end 102 of the nozzle. To this end, referring now to FIGS. 4–9, the fuel swirler 111 includes a gallery or plenum 140 formed in the outer surface of the fuel swirler, at the upstream end of the swirler (that is, the end toward the air inlet end 123). Plenum 140 extends along an axial and circumferential portion of the swirler and has a depth through a portion of the swirler. The plenum has a generally rectangular configuration, and is located such that the fuel conduit 58 opens toward the upstream side of the plenum. The plenum could also have other configurations, such as trapezoidal, with the flow area decreasing from the upstream end to the downstream end. The dimensions and configuration of the plenum are determined primarily by the volume and pressure of the fluid entering the nozzle.

A plurality of fuel channels or passages 144*a*–144*l* interconnect the plenum 140 with the discharge end of the fuel swirler. Passages 144*a*–144*l* are also formed on the outer surface of the swirler, and each has an upstream end that directly and individually opens to the plenum, and a downstream end that defines a discharge orifice 146*a*–146*l*, respectively. The upstream ends of the passages are preferably spaced apart around the plenum, such that the fuel is directed evenly into the passages. As illustrated, the passages open to three sides of the plenum, but it should be appreciated that the passages could open to all sides of the plenum, or to fewer than three. The number of passages can also vary, depending again, on the flow through the nozzle. It is preferred that the plenum and the passages have a sufficient dimension (and that there are a sufficient number of passages) such that fuel can enter the plenum and be evenly distributed to each of the passages for distribution by the nozzle without substantial pressure drop.

The passages 144*a*–144*d* opening to the downstream side of the plenum extends substantially axially straight downstream therefrom to their respective discharge orifices 146*a*–146*d*. Passages 144*a*–144*d* are evenly spaced-apart, and parallel to one another. For the passages 144*e*–144*l* that open to the other sides of the plenum, the passages are angled and extend around the opposite side of the swirler (see FIG. 5), and then extend axially straight downstream, in parallel, evenly-spaced relation, to their respective discharge orifices 146*e*–144*l* (see, e.g., FIG. 6).

The downstream ends of the passages 144*a*–144*l* are angled (in the same direction) with respect to the geometric axis of the fuel swirler, such that the fuel directed outwardly from the orifices 146*a*–146*l* is provided with a swirling component of motion. The particular angle of the passages can vary depending upon the desired swirl for the fuel.

The fuel from the discharge orifices is then applied to the downstream end 114 of the prefilmer 110. The fuel detaches from the prefilmer, and is impacted by the inner and outer air flows created by air swirlers 96, 103 and 120.

Figure 7:
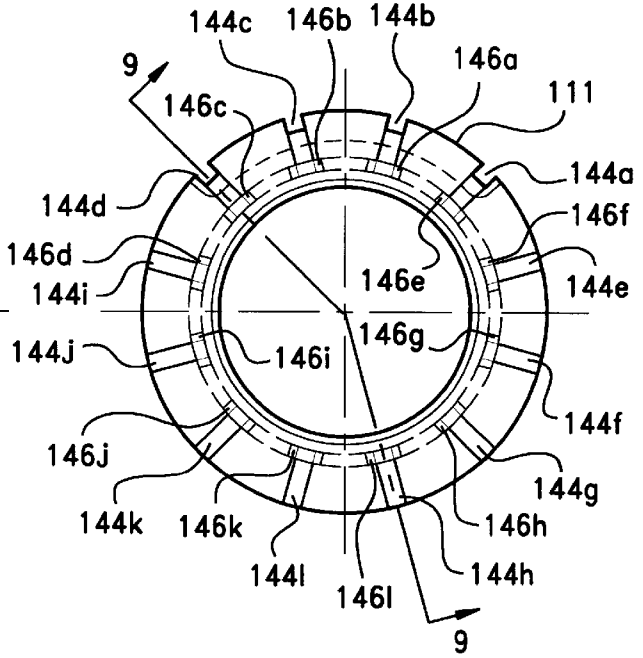
FIG. 7 is an end view of the fuel swirler for the fuel injector.
Figure 9:
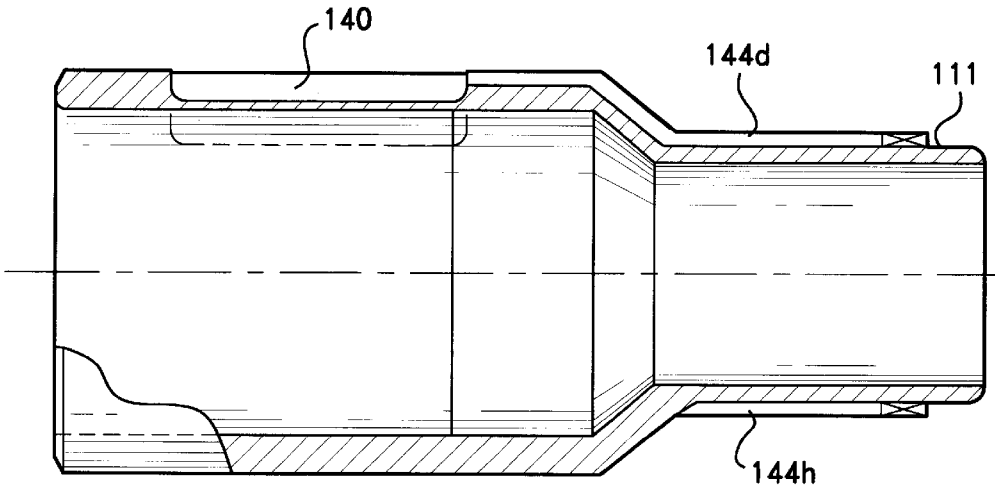
FIG. 9 a cross-sectional side view of the fuel swirler, taken substantially along the plane described by the lines 9—9 of FIG. 7.

As can be seen particularly in FIG. 7, the discharge orifices 146*a*–146*l* are provided around the entire circumference of the nozzle, in even, spaced apart relation to one another, such that fuel is sprayed uniformly by the nozzle. Uniform spray patternization is provided for efficient combustion and good flame stability. By matching the dimensions of the plenum 140 and passages 144*a*–144*l* to the dimensions of the fuel conduit 58, the fuel residence time in the nozzle is minimized, which thereby prevents coking.

The nozzle described above is formed from an appropriate heat-resistant and corrosion resistant material which should be known to those skilled in the art. The nozzle is formed using conventional manufacturing techniques, with the plenum 140 and passages 146 in the fuel swirler preferably formed by milling. While a preferred form of the nozzle has been described above, it should be apparent to those skilled in the art that other nozzle (and stem) designs could also be used with the present invention. The invention is not limited to any particular nozzle design, but rather is appropriate for a wide variety of commercially-available nozzles.

In any case, referring again to FIGS. 1–3, in assembling the fuel injector, the inner heat shield 116, air swirler 120, fuel swirler 111, prefilmer 110 and outer air swirlers 96, 103, are initially assembled such as by brazing. The fuel conduit 58 is then sealed to fitting 36. Next, the fuel conduit 58 is inserted into bore 52 of housing stem 42, with the downstream end of fuel conduit 58 being received within the opening 113 in prefilmer 110 and brazed thereto. The air swirler 96 is then welded to the outer shroud 94 of the housing stem. The assembled fuel injector can then be inserted through the opening 32 in the engine casing (see FIG. 1), with the nozzle being received within the opening 34 in the combustor. The flange 90 on the fuel injector is then secured to the engine casing such as with bolts or rivets. The nozzle is not otherwise attached to the combustor to allow for simple and rapid removal of the fuel injector from the engine casing.

Thus, as described above, the assembly of the internally heatshielded nozzle is fairly straight-forward and can be accomplished using only a few assembly steps with common assembly techniques, such as milling and brazing. There are no complicated internal components, which thereby reduces the material cost of the fuel injector.

The present invention thereby provides an improved fuel injector for gas turbine engines, and particularly an improved fuel swirler for such an injector, which provides a uniform spray for efficient combustion and stability of the flame; minimizes the pressure drop across the swirler; is simple and low-cost to manufacture; and prevents coking internally of the nozzle.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A fuel injector for a gas turbine engine, the fuel injector comprising:

a housing stem having an internal fuel conduit for receiving fuel;

a nozzle supported by the housing stem, said nozzle including a fuel swirler directing fuel from the internal fuel conduit to discharge orifices at a discharge end of the fuel swirler, the fuel swirler having an outer surface including a plenum located to receive fuel from the fuel conduit, and a plurality of passages individually and separately connected to the plenum and fluidly interconnected with respective discharge orifices, the discharge orifices circumferentially surrounding the fuel swirler to provide uniform distribution of the fuel around the fuel swirler.

2. The fuel injector as in claim 1, wherein the downstream ends of said fuel passages are angled with respect to the geometric axis of the fuel swirler, such that the fuel is dispensed through the discharge orifices with a swirling component of motion.

3. The fuel injector as in claim 1, wherein the discharge orifices are evenly spaced around the fuel swirler.

4. The fuel injector as in claim 1, wherein said fuel passages are fluidly separated from each other from the plenum to the discharge orifices.

5. The fuel injector as in claim 4, wherein the plenum is provided toward the upstream end of the fuel swirler.

6. The fuel injector as in claim 1, wherein some of the fuel passages extend in an axially straight direction from the plenum to their respective discharge orifices, while others of the fuel passages extend initially at an angle to the axis to a side of the fuel swirler opposite from the plenum, and then extend in an axially straight direction to their respective discharge orifices.

7. The fuel injector as in claim 1, wherein the fuel passages circumferentially surround the fuel swirler.

8. The fuel injector as in claim 1, and further including an annular prefilmer outwardly surrounding the fuel swirler, and together with the fuel swirler, defining a fuel pathway through the nozzle.

9. A fuel injector for a gas turbine engine having a combustor casing with an opening, the fuel injector comprising:

a fitting for receiving fuel, said fitting designed to be located exterior to the combustor casing;

a nozzle for dispensing fuel, said nozzle designed to be located within the combustor casing;

a housing stem extending between and interconnecting the fitting and said nozzle, said housing stem having an internal fuel conduit fluidly interconnecting the fitting and the nozzle; said nozzle including a fuel swirler directing fuel from the internal fuel conduit to discharge orifices at a discharge end of the fuel swirler, and an annular prefilmer closely surrounding the fuel swirler, the fuel swirler having an outer surface including a plenum located to receive fuel from the fuel conduit, and a plurality of passages individually and separately connected to the plenum and fluidly interconnected with respective discharge orifices, the discharge orifices circumferentially surrounding the fuel swirler to provide uniform distribution of the fuel around the fuel swirler.

10. The fuel injector as in claim 9, wherein the downstream ends of said fuel passages are angled with respect to the geometric axis of the fuel swirler, such that the fuel is dispensed through the discharge orifices with a swirling component of motion.

11. The fuel injector as in claim 10, wherein the discharge orifices are evenly spaced around the fuel swirler.

12. The fuel injector as in claim 11, wherein said fuel passages are fluidly separated from each other from the plenum to the discharge orifices.

13. The fuel injector as in claim 12, wherein the fuel passages circumferentially surround the fuel swirler.

14. The fuel injector as in claim 13, wherein the plenum is provided toward the upstream end of the fuel swirler.

15. The fuel injector as in claim 14, wherein some of the fuel passages extend in an axially straight direction from the plenum to their respective discharge orifices, while other of the fuel passages extend initially at an angle to the axis to a side of the fuel swirler opposite from the plenum, and then extend in an axially straight direction to their respective discharge orifices.

16. A fuel injection assembly for a gas turbine engine, comprising:

a combustor casing with an opening and a fuel injector, said fuel injector including:

a) a fitting for receiving fuel, said fitting designed to be located exterior to the combustor casing;

b) a nozzle for dispensing fuel, said nozzle designed to be located within the combustor casing; and c) a housing stem extending between and interconnecting the fitting and said nozzle, said housing stem having an internal fuel conduit fluidly interconnecting the fitting and the nozzle; said nozzle including a fuel swirler directing fuel from the internal fuel conduit to discharge orifices at a discharge end of the fuel swirler, and an annular prefilmer closely surrounding the fuel swirler, a pathway defined between the fuel swirler and the prefilmer to direct fuel through the nozzle, the pathway including a plenum located to receive fuel from the fuel conduit, and a plurality of passages individually and separately connected to the plenum and fluidly interconnected with respective discharge orifices, the discharge orifices circumferentially surrounding the fuel swirler in an even, spaced apart arrangement to provide uniform distribution of the fuel around the fuel swirler, and wherein the downstream ends of said fuel passages are angled with respect to the geometric axis of the fuel swirler, such that the fuel is dispensed through the discharge orifices with a swirling component of motion.

* * * * *